United States Patent [19]

Tang et al.

[11] Patent Number: 4,652,843

[45] Date of Patent: Mar. 24, 1987

[54] PLANAR DUAL-MODE CAVITY FILTERS INCLUDING DIELECTRIC RESONATORS

[75] Inventors: Wai-Cheung Tang, Kitchener; David Siu, Hamilton; Bruce C. Beggs, Mississauga; Joseph Sferrazza, Hamilton, all of Canada

[73] Assignee: Com Dev Ltd., Cambridge, Canada

[21] Appl. No.: 667,823

[22] Filed: Nov. 2, 1984

[30] Foreign Application Priority Data

May 28, 1984 [CA] Canada ..... 455283

[51] Int. Cl.[4] ..... H01P 1/209

[52] U.S. Cl. ..... 333/212; 333/227; 333/230

[58] Field of Search ..... 333/202, 208, 209, 210, 333/211, 212, 219, 227, 230, 235, 248

[56] References Cited

U.S. PATENT DOCUMENTS

| | | | |
|---|---|---|---|
| 4,028,651 | 6/1977 | Leetma | 333/230 X |
| 4,129,846 | 12/1978 | Mok | 333/227 X |
| 4,180,787 | 12/1979 | Pfitzenmaier | 333/230 X |
| 4,433,146 | 6/1984 | Fiedziuszko | 333/230 X |
| 4,484,162 | 11/1984 | Kamada et al. | 333/219 |
| 4,489,293 | 12/1984 | Fiedziuszko | 333/202 |

FOREIGN PATENT DOCUMENTS

| | | | |
|---|---|---|---|
| 1050127 | 3/1979 | Canada | 333/212 |

*Primary Examiner*—Eugene R. LaRoche
*Assistant Examiner*—Benny T. Lee
*Attorney, Agent, or Firm*—Daryl W. Schnurr

[57] ABSTRACT

A bandpass filter has a plurality of cascade cavities that operate in a dual-mode and are mounted in a planar relationship to one another. Each cavity contains a dielectric resonator and resonates at its resonant frequency in two $HE_{11\delta}$ modes. An iris is located between adjacent cavities and contains an aperture that can independently control inter-cavity coupling. The dielectric resonator is cylindrical in shape and an adjustable metallic plunger is located in a wall of each cavity so that the cavity can be tuned over a relatively broad range. The filter has good mechanical and thermal stability as well as being extremely flexible in the arrangement of cavities.

18 Claims, 9 Drawing Figures

PLANAR DUAL-MODE CAVITY FILTERS INCLUDING DIELECTRIC RESONATORS

BACKGROUND OF THE INVENTION

1. Field of the Invention

This invention relates to a dual-mode bandpass filter with at least two adjacent cavities being mounted in a planar relationship to one another.

2. Description of the Prior Art

It is known to have a dual-mode bandpass filter with each cavity being mounted in an axial relationship to one another and containing a dielectric resonator. This type of filter is described in Institute of Electrical and Electronics Engineers Transaction on Microwave Theory and Techniques, Vol. MTT-30, No. 9, September, 1982, pages 1311–1316, by S. J. Fiedziuszko. A filter with axially mounted cavities has some disadvantages in that the cavities must be manufactured within a narrow tolerance as the dimensions of each cavity are critical. This makes the cavity relatively expensive to manufacture. Also, axially mounted cavities are more difficult to mount on a channel or can only be tuned over a relatively narrow range.

It is an object of the present invention to provide a bandpass filter having adjacent cavities that are mounted in a planar relationship relative to one another, contain a dielectric resonator and are versatile in that they can be tuned over a relatively broad range.

SUMMARY OF THE INVENTION

In accordance with the present invention, a bandpass filter has a plurality of cascade cavities with at least two adjacent cavities being mounted in a planar relationship to one another so that longitudinal axes of said adjacent cavities are parallel to one another. Each of said adjacent cavities contains a dielectric resonator mounted coaxially with the longitudinal axis of that cavity each of said adjacent cavities having a square cross-sectional shape transverse to a longitudinal axis. Each of said adjacent cavities resonates at its resonant frequency in two orthogonal $HE_{11\delta}$ modes, where $\delta$ is a natural number. An inter-cavity coupling iris is located between said adjacent cavities and contains an aperture to independently control inter-cavity coupling between the two orthogonal $HE_{11\delta}$ modes. The aperture has two separate slots. The filter has tuning screws and coupling screws as well as an input and an output. Preferably the dielectric resonator in each adjacent cavity is cylindrical in shape and an adjustable metallic plunger is located in a wall of said cavity and is mounted axially with said resonator.

BRIEF DESCRIPTION OF THE DRAWINGS

In drawings which illustrate a preferred embodiment of the invention.

DESCRIPTION OF A PREFERRED EMBODIMENT

Figure 1:
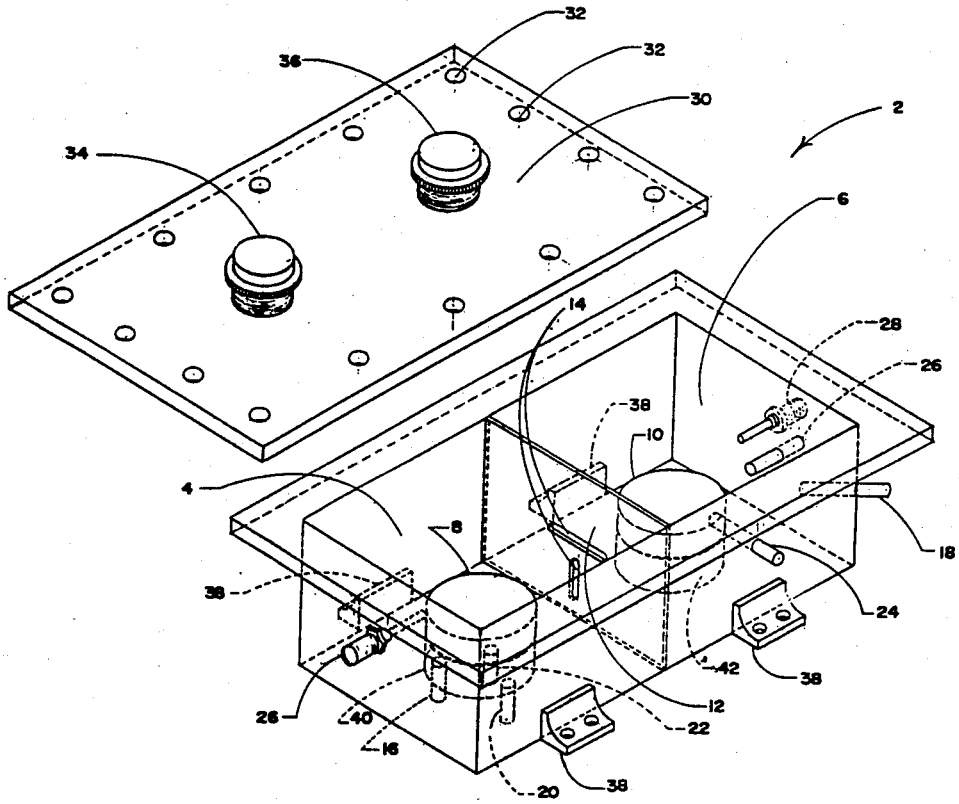
FIG. 1 is a perspective view of a two cavity bandpass filter with a cover removed.

Referring to the drawings in greater detail, in FIG. 1 a bandpass filter 2 has two adjacent cavities 4, 6 mounted in a planar relationship to one another. A "planar relationship" shall be interpreted to mean that the cavities are mounted side by side in a common plane with each cavity having a longitudinal axis that is parallel to, but different from, a longitudinal axis of the remaining cavities. The "longitudinal axis" of each cavity shall be interpreted to be that axis that is parallel to a side wall of the cavity. Each cavity 4, 6 has a square cross-sectional shape transverse to said longitudinal axis. Each cavity 4, 6 contains a dielectric resonator 8, 10 respectively that is cylindrical in shape and is mounted axially in said cavity. An intercavity coupling iris 12 is located between said cavities 4, 6. The iris 12 has an aperture 14 that will be described in more detail below. A coupling screw 16 is located in the cavity 4 and a coupling screw 18 is located in the cavity 6. Tuning screws 20, 22 are located in the cavity 4 and tuning screws 24, 26 are located in the cavity 6. The coupling screw 16 and the tuning screws 20, 22 in the cavity 4 are located parallel to an axis of the dielectric resonator 8 at a constant distance away from said axis. The coupling screw 18 and tuning screws 24, 26 in the cavity 6 are located transverse to an axis of the dielectric resonator 10. The filter 2 has an input 26 and an output 28.

A cover 30 has been removed from the filter 2 and is designed to fit over a top of the filter 2 and to be held in place by screws (not shown) inserted into openings 32. The cover 30 has two large threaded openings (not shown) into which have been inserted adjustable metallic plungers 34, 36. The plunger 34 is located in said cover 30 so that it is mounted axially with the resonator 8 of the cavity 4 when the cover 30 is in place on the filter 2. The plunger 36 is located in said cover 30 so that it is mounted axially with the resonator 10 of the cavity 6 when the cover 30 is in place on the filter 2. While the adjustable plungers 34,36 are shown in FIG. 1 to be located in the cover 30, access to the cavity could be gained by other means and the plungers could be located in a permanent wall of each cavity.

Brackets 38 are affixed to either side of each cavity 4, 6 and are used to rigidly affix the filter 2 to a panel (not shown). Cylindrical supports 40, 42 support the resonators 8, 10 respectively.

Figure 2:
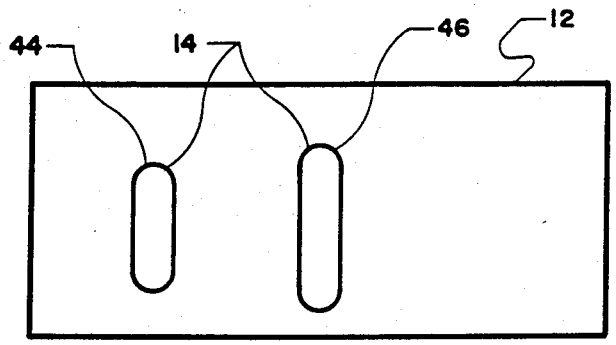
FIG. 2 is a side view of one type of iris used in the filter.

Referring to FIG. 2 in greater detail, there is shown one type of aperture 14 located in an iris 12. The iris 14 has two separate slots 44, 46 that are parallel to one another. The slot 46 is symmetrical about a centre line of said iris. Each resonator has a centre axis that is parallel to the longitudinal axis of the cavity in which the resonator is located. The slot 46 is larger than the slot 44 and the slot 44 is offset from said centre line.

Figure 3:
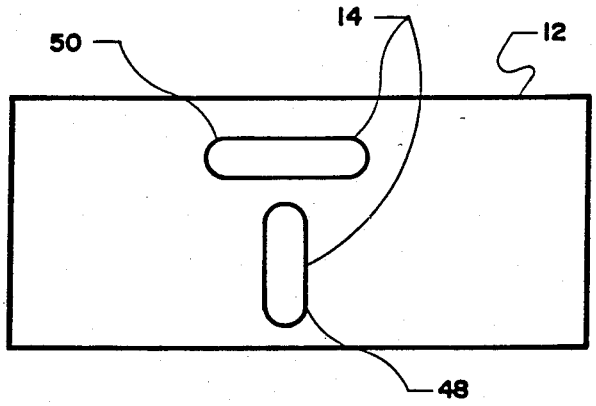
FIG. 3 is a side view of another type of iris used in the filter.

Referring to FIG. 3 in greater detail, there is shown a further variation of an aperture 14 located in an iris 12. The aperture 14 has two separate slots 48, 50 that are normal to one another. Both slots 48, 50 are symmetrically located about a vertical centre line of said iris 12 when said cavities lie in a horizontal plane. The slot 50 is horizontal and is located above the slot 48, which is vertical.

Figure 4:
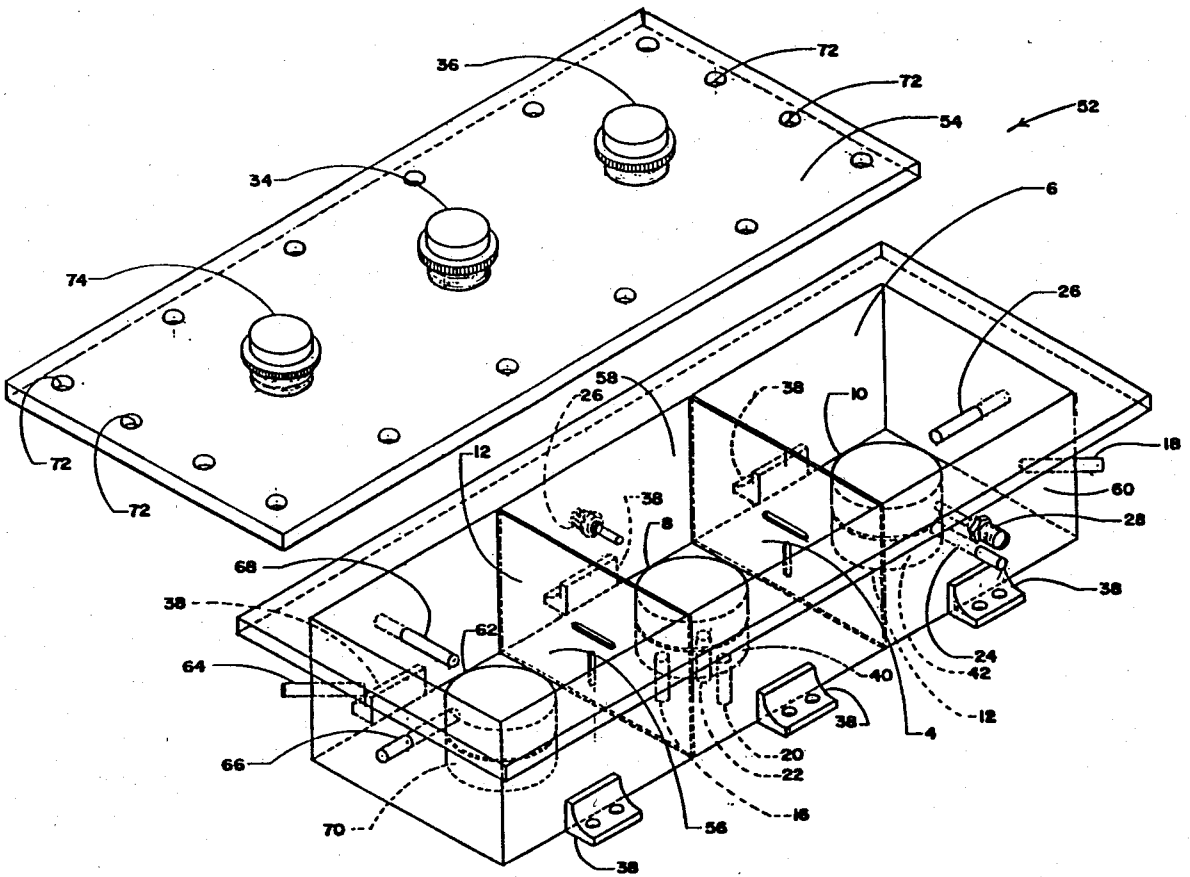
FIG. 4 is a perspective view of a three cavity bandpass filter in accordance with the present invention with the cover removed.

Referring to FIG. 4 in greater detail, there is shown a three cavity filter 52. The filter 52 is nearly identical to the filter 2 shown in FIG. 1 except that it has one extra cavity. Two of the cavities and the component parts thereof that are the same as those of FIG. 1 will be designated using the same reference numerals. The remaining cavity, even though it too is very similar to that described in FIG. 1, is designated with different reference numerals. A cover 54 of the filter 52 is removed for purposes of illustration. The filter 52 has three cavities 4, 6, 56. The cavity 4 of FIG. 4 is essentially the same as the cavity 4 of FIG. 1 except that the input 26 has been relocated to a side wall 58 and an iris 12 is located between the cavity 4 and the cavity 56 as well as between the cavity 4 and the cavity 6. The output 28 of the filter 52 is located in a side wall 60 of the cavity 6.

The cavity 56 contains a dielectric resonator 62 that is cylindrical in shape. A coupling screw 64 is located in the cavity 56 as well as tuning screws 66, 68. The dielectric resonator 62 is supported in the cavity 56 by a cylindrical support 70. The three cavities 56, 4, 6, are said to be in a linear planar relationship because they are in a single row.

The cover 54 has been removed from the filter 52 and is designed to be held in place on said filter by screws (not shown) inserted into openings 72. The cover 54 has three large threaded openings (not shown) into which have been inserted adjustable metallic plungers 34, 36, 74. The plunger 34 is located in said cover 54 so that when the cover is in place on said filter 52, the plunger 34 is mounted axially with the resonator 8 of the cavity 4. Similarly, the plunger 36 is located so that it is mounted axially with the resonator 10 of the cavity 6 and the plunger 74 is mounted axially with the resonator 62 of the cavity 56.

In operation, the filter 2 of the FIG. 1 has an input cavity 4 and an output cavity 6. Each cavity resonates in first and second $HE_{11\delta}$ modes (where $\delta$ is a natural number). The coupling iris 12 provides inter-cavity coupling means through an aperture 14. While there are two physical cavities, there are four electrical cavities as the filter 2 is a dual mode filter. Inter-cavity coupling between the two orthogonal modes within a given cavity is achieved by means of a physical discontinuity which perturbs the electric field of one mode to couple energy into another mode. In FIG. 1, the physical discontinuity is coupling screws 16, 18 located in cavities 4, 6 respectively. The coupling screw 18 is mounted at a 45° angle relative to the tuning screws 24, 26 of the cavity 6. The coupling screw 16 and the tuning screws 20, 22 are mounted parallel to an axis of the dielectric resonator 8 at a constant distance away from said axis.

The tuning screws perturb the electrical field of each orthogonal mode independently and decrease the cutoff frequency of the dielectric resonator in the plane of each screw. Therefore, the cavity length for each mode appears electrically larger than its physical length. Inter-cavity $HE_{11\delta}$ to $HE_{11\delta}$ coupling is influenced by a magnetic field energy transfer through the aperture 14 of the iris 12. The input 26 and the output 28 are coaxial probes. The probes couple energy to the $HE_{11\delta}$ mode polarized in the direction of the probe antenna through electrical field coupling.

The location of the tuning screws 20, 22 parallel to the axis of the resonator 8 provides the same tuning effect as the location of the tuning screws 24, 26 transverse to the axis of the resonator 10. In both cases, the electric field must distort in order to be perpendicular to the screws. The distortion of the electric field effectively lengthens the resonator for the mode being tuned and lowers the resonant frequency. The coupling screws 16, 18 operate in a similar manner to the tuning screws.

In the filter 2, it is not necessary to have the coupling screws 16 and the tuning screws 20, 22 located parallel to an axis of the resonator 8. Since the cavity 4 is located at an end of the filter 2, the coupling screw 16 and the tuning screws 20, 22 can be located transverse to the axis of the resonator 8 in a manner similar to those of cavity 6. However, in the three cavity planar filter 52 as shown in FIG. 4, where the cavities are arranged in a linear manner, the centre cavity 4 cannot have two independent orthogonal tuning screws that are transverse to the axis of the resonator 8 and are externally variable. Therefore, the coupling screw 16 and the tuning screws 20, 22 are located parallel to the axis of the resonator 8 as shown in FIG. 4. The same arrangement would be used whenever the cavities are arranged in a planar relationship where one or more cavities would not have two external side walls that are normal to one another. The cavities of a filter could be arranged so that they are planar but not linear. For example, four cavities could be arranged in a square configuration.

The metallic plungers 34, 36 of the filter 2 can be used to vary the frequency of resonance of the dielectric resonators 8, 10 respectively by effectively shortening or lengthening the resonant length of each resonator. By rotating the plungers 34, 36 so that they are closer to the resonators 8, 10 respectively, will raise the resonant frequency. Rotating said plungers in the opposite direction so that they are further away from said resonators will lower the resonant frequency. While the tuning screws are useful for fine tuning of the filter, the metallic plungers can be used to greatly increase the tuning range of the filter. The plungers of the filter 52 can be manipulated in the same manner.

The resonators 8, 10 of the filter 2 are supported on supports 40, 42 respectively. Each resonator has a centre axis that is parallel to the longitudinal axis of the cavity in which the resonator is located. The supports 40, 42 can be made of a low loss dielectric constant material, for example, Rexolite (a trade mark) or quartz. For applications requiring good heat transfer such as high power filters, the supports can be made of metal. Unlike the axial filter, the planar filters of the present invention are thermally very stable and differences in expansion between the metallic cavity, the support and the dielectric resonator will not stress the structure. Also, in high power filters, when the filter of the present invention is mounted on a panel, that part of the filter that is in contact with the panel provides an excellent contact surface for heat transfer.

The slots 44, 46 of the iris 12 shown in FIG. 2 provide inter-cavity coupling means between the $HE_{11\delta}$ modes. The iris 12 is metallic and the slots 44, 46 can be moved in a vertical direction, when the cavity is in an upright position, to vary the strength of magnetic coupling. The slot 46 couples magnetic field energy from one set of orthogonal $HE_{11\delta}$ modes in adjacent cavities whose magnetic field is polarized in the direction of the slot. The slot 44 couples magnetic field energy from both sets of $HE_{11\delta}$ modes in adjacent cavities since it is not orthogonal to slot 46. The arrangement of the slots 44, 46 as shown in FIG. 2 cannot provide independent control for intercavity coupling between two orthogonal $HE_{11\delta}$ modes. Further variations in the location of the slots could be made. For example, the slot 46 could be enlarged and moved slightly off centre. Further, the slot 44 could be located further away from or closer to the slots 46 or it could be located on the opposite side of the slot 46.

In FIG. 3, the slot 48 couples magnetic field energy between one pair of $HE_{11\delta}$ modes in adjacent cavities in the same manner as the slot 46 of FIG. 2. The slot 50 couples electric field energy between the second pair of orthogonal $HE_{11\delta}$ modes whose electric field is polarized perpendicular to the plane of the iris 12. The arrangement of the slots 48, 50 allows the coupling between the two sets of $HE_{11\delta}$ modes in two adjacent cavities to be independently controlled because one slot couples magnetic field energy and the other couples electric field energy. The slots 48, 50 can be moved vertically relative to the iris 12 and relative to one another to vary the strength of coupling between the modes that each slot affects in each cavity. Further variations could be made in the location of the slots. For example, the slots could be enlarged and located somewhat off centre. However, the location of the slots symmetrical with the centre line of the iris 12 is considered to be the optimum location.

The three cavity filter 52 shown in FIG. 4 operates in a similar manner to the two cavity filter 2 shown in FIG. 1. The coupling screw 16 and the tuning screws 20, 22 of the centre cavity 4 of the filter 52 are mounted parallel to an axis of the dielectric resonator 8. The centre cavity 4 does not have two exposed side walls that are arranged perpendicular to one another and it is therefore most convenient that the coupling screw and tuning screws be arranged in this manner. The cavities 6, 56 do have two exposed side walls that are arranged perpendicular to one another and can be referred to as end cavities. In the end cavities, it is not necessary to arrange the coupling and tuning screws so that they are mounted parallel to an axis of the dielectric resonator of each cavity. The filter 52 operates as a fully elliptic six pole filter.

It is known by those skilled in the art that if one has a six pole dual mode filter with one cavity located between an input and an output cavity, that filter will not be able to produce a true elliptic response but only a quasi-elliptic response. It is also known that if the input and output cavity of a dual mode six pole filter are located adjacent to one another and the third cavity is located adjacent to the output cavity on a side opposite to the input cavity or adjacent to the input cavity on a side opposite to the output cavity, that filter can be made to produce a true elliptic response. The same considerations for arranging the cavities apply to the filter 52. If the cavities are arranged as shown in FIG. 4 so that the cavity 56 is located adjacent to the input cavity 4 on a side opposite to the output cavity 6, the maximum number of transmission zeros and therefore a true elliptic response can be achieved by the filter 56. Similarly, the cavity 56 could be located adjacent to the output cavity 6 on a side opposite to the input cavity 4 to achieve the same true elliptic response.

Figure 5:
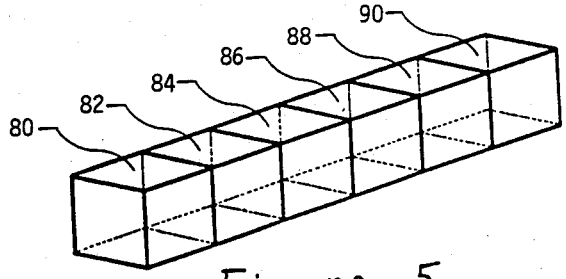
FIGS. 5, 6 and 7 are perspective views of variations in the arrangement of cavities; and, FIGS. 8 and 9 are graphs showing experimental response characteristics of two cavity dual mode filters as shown in FIG. 1.
Figure 6:
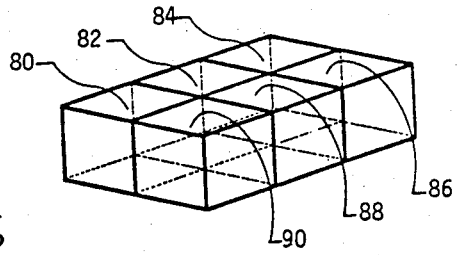
Figure 7:
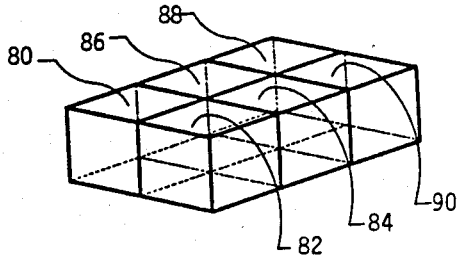

In FIGS. 5, 6, 7 there is shown variations in the arrangement of cavities for a planar filter in accordance with the present invention. In FIG. 5, there is shown a filter having six linearly arranged cavities, 80, 82, 84, 86, 88, 90. In FIG. 6, the same cavities have been rearranged in two parallel rows so that cavities 80, 82, 84 are adjacent to cavities 90, 88, 86 respectively. It should be noted that in this arrangement, the cavities 80, 90 are side by side. If the cavity 80 is the input cavity and the cavity 90 is the output cavity, further flexibility could be achieved in the operation of the filter in that coupling could be made to occur between the input and output cavities. In FIG. 7, the cavities are again re-arranged in two parallel rows except that the cavities 80, 82, 84 are arranged side by side with the cavities 86, 88, 90 respectively. In FIGS. 5, 6 and 7, for ease of illustration, all of the component parts of each of the cavities, other than the cavities themselves have been omitted.

Figure 8:
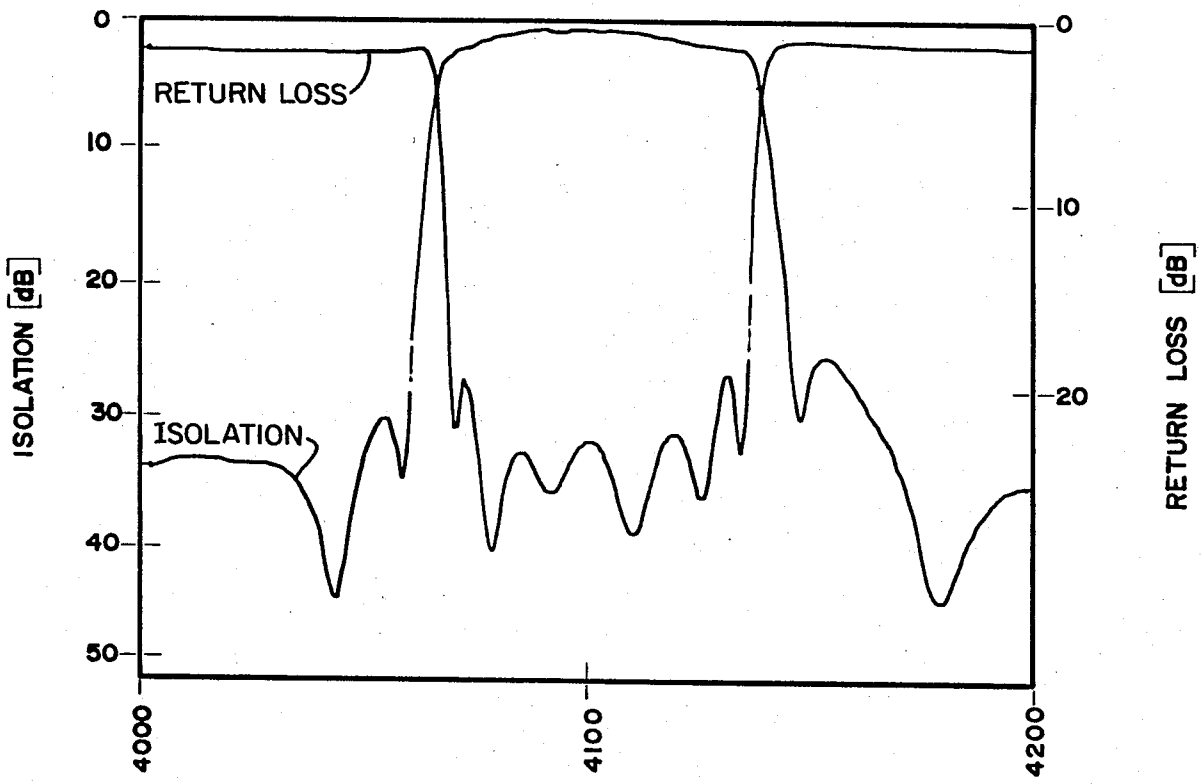
Figure 9:
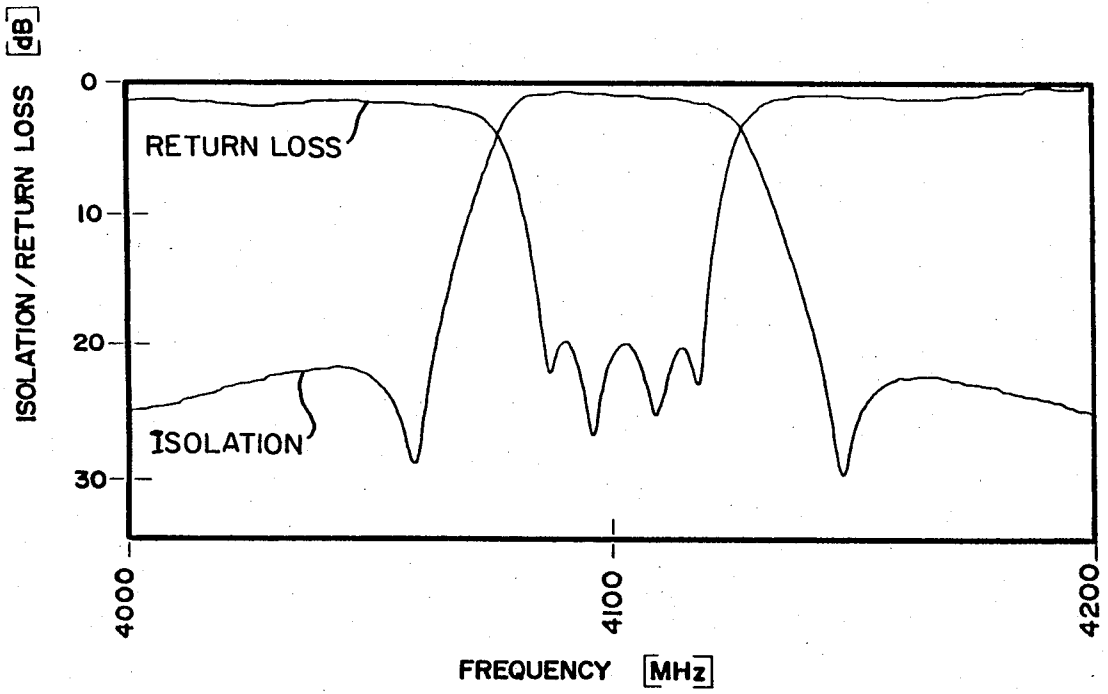

In FIG. 8, there is shown the measured amplitude response and return loss response of a two cavity four pole elliptic filter constructed in accordance with the filter 2 of FIG. 1. It can readily be seen that the response shown in FIG. 8 represents a true elliptic function and that the filter has four equi-ripple peaks in the return loss. In FIG. 9, there is shown an amplitude response and return loss response of a six pole three cavity filter constructed in accordance with the filter 52 shown in FIG. 4.

While the filter shown in FIG. 1 has two physical cavities and the filter shown in FIG. 4 has three physical cavities, it will be readily apparent to those skilled in the art that it will be possible to design a filter having any reasonable number of cavities. Where a filter is of the order N, N being an integer multiple of 2, the number of physical cavities is equal to N/2.

The filters constructed in accordance with the present invention, in addition to their mechanical and thermal stability and their flexibility in the arrangement of cavities, are also attractive from a manufacturing point of view in that the cavity dimensions are not highly critical. The metallic plungers allow the filters to be tuned over a relatively wide frequency range. In some uses, it is possible by proper choice of coefficient of thermal drift of the resonator material itself, to obtain a filter which has a near zero frequency verses temperature drift over a reasonable range of temperatures. These features are desirable in the use of filters of the present invention in satellite transponders.

What we claim as our invention is:

1. A bandpass filter comprising a plurality of cascade cavities, with at least two adjacent cavities being mounted in a planar relationship so that longitudinal axes of said adjacent cavities are parallel to one another, with each of said adjacent cavities containing a dielectric resonator mounted coaxially with the longitudinal axis of that cavity, each of said adjacent cavities having a square cross-sectional shape transverse to said longitudinal axis and resonating at its resonant frequency in two orthogonal $HE_{11\delta}$ modes, where $\delta$ is a natural number, with an inter-cavity coupling iris located between said adjacent cavities, said iris containing an aperture to independently control inter-cavity coupling between the two orthogonal $HE_{11\delta}$ modes, said aperture having two separate slots, said filter having tuning screws and coupling screws as well as an input and output.

2. A filter as claimed in claim 1 wherein the two separate slots of the aperture are normal to one another.

3. A filter as claimed in claim 2 wherein both slots are symmetrically located about a centre line of said iris, said centre line being parallel to said longitudinal axis of each cavity.

4. A filter as claimed in claim 1 wherein the aperture has two separate slots that are parallel to one another.

5. A filter as claimed in claim 4 wherein one slot is larger than the other slot and the larger slot is symmetrical about a centre line of said iris, said centre line being parallel to said longitudinal axis of each cavity and the smaller slot is offset from said centre line.

6. A filter as claimed in any one of claims 1, 2 or 4 wherein the dielectric resonators are cylindrical in shape and an adjustable metallic plunger is located in a wall of each cavity and is mounted axially with the resonator of said cavity.

7. A filter as claimed in any one of claims 1, 2 or 4 wherein there are at least three adjacent cavities, two of said cavities being end cavities and the remaining cavities being located between the end cavities, the tuning and coupling screws of said remaining cavities being located parallel to said longitudinal axis of each cavity at a constant distance away from said axis.

8. A filter as claimed in claim 2 wherein one slot couples magnetic field energy and the other slot couples electric field energy.

9. A filter as claimed in any one of claims 1, 3 or 5 wherein the dielectric resonator of each cavity is supported on a low loss support of dielectric material.

10. A filter as claimed in any one of claims 1, 3 or 5 wherein the dielectric resonator of each cavity is supported on a metallic support.

11. A filter as claimed in any one of claims 1, 3 or 5 wherein tuning screws and coupling screws are located at an equal radius from said longitudinal axis of each cavity.

12. A filter as claimed in any one of claims 1, 3 or 5 wherein the input and output are comprised by coaxial probes.

13. A filter as claimed in any one of claims 3, 4 or 5 wherein the input and output of said filter are comprised by coaxial probes.

14. A filter as claimed in any one of claims 1, 3 or 5 wherein the input and output of said filter is by means of an iris slot.

15. A filter as claimed in any one of claims 1, 3 or 5 wherein the adjacent cavities are linearly arranged side by side in a single row.

16. A filter as claimed in any one of claims 1, 3 or 5 wherein the filter is of the order N, N being an integer multiple of 2 and the number of cavities is equal to N/2.

17. A filter as claimed in any one of claims 1, 3 or 5 wherein the cavities are arranged in two parallel rows.

18. A filter as claimed in any one of claims 1, 3 or 5 wherein the cavities are arranged in two parallel rows so that an input cavity and an output cavity are arranged adjacent to each other in different rows.

* * * * *